United States Patent [19]

Scheiwiller

[11] Patent Number: 4,782,640

[45] Date of Patent: Nov. 8, 1988

[54] STRUCTURAL ASSEMBLY FOR PRODUCING INTERCONNECTED STRUCTURES

[76] Inventor: Rolf Scheiwiller, Lindeneggweg 10, CH-3645 Gwatt, Switzerland

[21] Appl. No.: 905,407

[22] Filed: Sep. 10, 1986

[30] Foreign Application Priority Data

Sep. 26, 1985 [EP] European Pat. Off. ..... 85810442

[51] Int. Cl.[4] ..... E04C 1/10

[52] U.S. Cl. ..... 52/586

[58] Field of Search ..... 52/586, 593, 98, 100, 52/605, 608, 125.3, 606, 503, 603, 562; 405/284–287; 47/82, 83

[56] References Cited

U.S. PATENT DOCUMENTS

| | | | |
|---|---|---|---|
| 3,490,800 | 1/1970 | Wissler | 52/586 X |
| 3,936,987 | 2/1976 | Calvin | 52/586 |
| 4,073,111 | 2/1978 | Warren | 52/603 |
| 4,229,123 | 10/1980 | Heinzmann | 52/606 X |
| 4,485,604 | 12/1984 | Palamara et al. | 52/606 X |
| 4,524,551 | 6/1985 | Scheiwiller | 52/98 |
| 4,532,747 | 8/1985 | Koetje | 52/586 |
| 4,597,236 | 7/1986 | Braxton | 52/586 X |

FOREIGN PATENT DOCUMENTS

| | | | |
|---|---|---|---|
| 2230055 | 6/1972 | Fed. Rep. of Germany . | |
| 1350543 | 12/1963 | France | 52/586 |
| 2376269 | 9/1976 | France . | |
| 477661 | 6/1953 | Italy | 52/605 |
| 487318 | 4/1970 | Switzerland | 52/605 |
| 612238 | 10/1978 | Switzerland . | |

*Primary Examiner*—J. Karl Bell

*Attorney, Agent, or Firm*—Marks Murase & White

[57] ABSTRACT

A structural assembly includes a square trough-shaped stone having inclined external corner regions and a dovetailed groove formed in each wall side. The dovetail tongue of a connecting plate fits into the dovetailed groove. At the lower end of the internal surface of each wall of the stone, a shoulder portion may be provided for accommodating base elements. The height of the connecting plate is advantageously greater than the height of the trough-shaped stone, so that the plate projects beyond the stone in a vertical direction for connection to further stones.

With such an assembly, it is possible to erect dry-stone type walls of various types. The individual elements of the assembly can be produced rationally and economically, and it is also possible to produce end elements and corner elements from the trough-shaped stones by cleaving the stones along grooves provided for such purpose.

24 Claims, 4 Drawing Sheets

FIG. 6
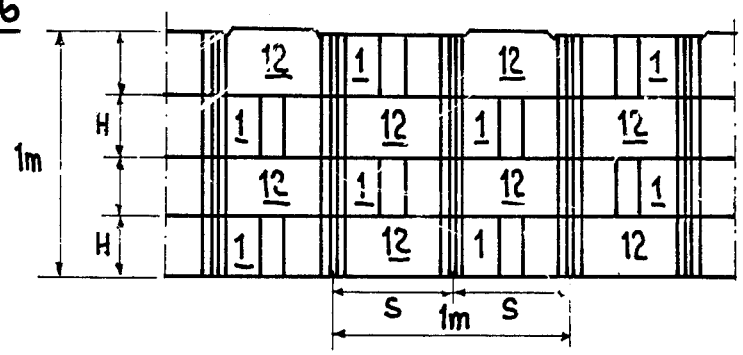
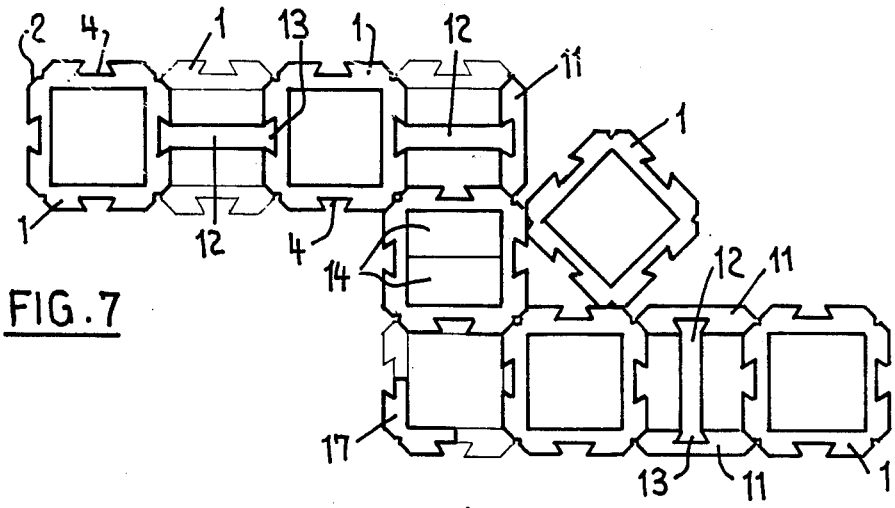
FIG. 7
FIG. 8
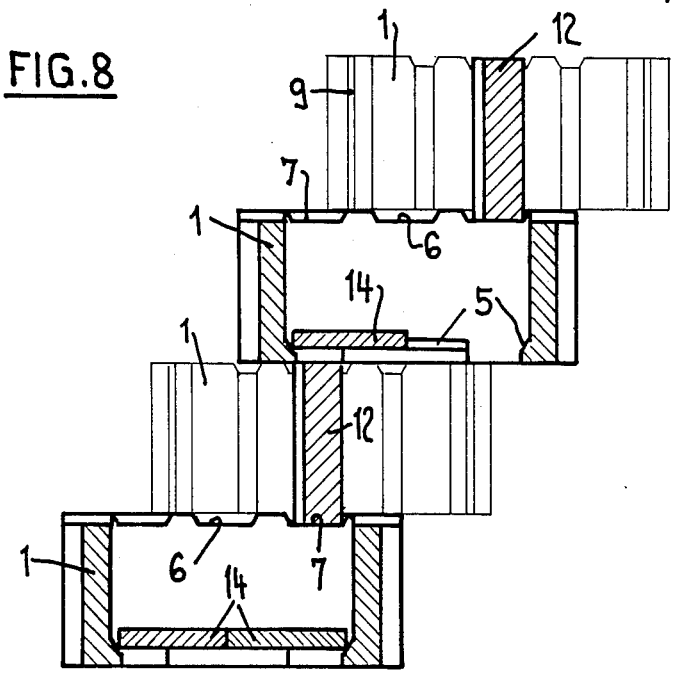

STRUCTURAL ASSEMBLY FOR PRODUCING INTERCONNECTED STRUCTURES

FIELD OF THE INVENTION

The present invention relates to a structural assembly for producing interconnected structures, particularly free-standing and/or soundproofing walls which may be produced using dry-stone construction methods.

BACKGROUND OF THE INVENTION

A large number of structural assemblies having a wide variety of different elements for producing walls such as, for example, free-standing walls and/or soundproofing walls are known. Some of the structural assemblies permit the walls to be erected using dry-stone construction methods. Some of the walls thus produced are capable of accommodating plants. In addtion, wall constructions for containing water therein and stones for containing grass therein are also known and have a similar form.

OBJECTS OF THE INVENTION

The present invention seeks to provide a structural assembly which permits walls to be produced using compound or interconnected construction methods, that is to say, in which the structural elements are interconnected horizontally. The present invention also seeks to provide a structural assembly which can also be used for making embankments or ramps and which is capable of accommodating plants on both sides. Furthermore, the present invention seeks to provide a structural assembly which offers numerous possible applications but which comprises a relatively small number of elements which can be produced as economically and rationally as possible.

SUMMARY OF THE INVENTION

According to the present invention, there is provided a structural assembly for producing interconnected structures, comprising a trough-shaped stone of substantially square shape, said stone comprising opposed pairs of side wall members, each said side wall member defining a dovetailed groove and adjacent ones of said side wall members jointly defining corner regions, each said corner region including an angled external surface and connecting plate means interconnecting adjacent ones of said trough-shaped stones, each said connecting member including at least one dovetail tongue member for fitting into said dovetailed groove, the height of said connecting plate being greater than the height of said trough-shaped stone.

BRIEF DESCRIPTION OF THE DRAWINGS

The invention will be further described, by way of example, with reference to the accompanying drawings which show various embodiments thereof. In the drawings:

FIG. 6 is a schematic view of a portion of a wall formed from the structural elements shown in FIGS. 1 to 5;

FIG. 7 is a schematic plan view of an alternative form of wall formed from the structural elements shown in FIGS. 1 to 5;

FIG. 8 shows the structural elements shown in FIGS. 1 to 5 used to form a sloping or stepped wall;

DESCRIPTION OF PREFERRED EMBODIMENTS

Figure 1:
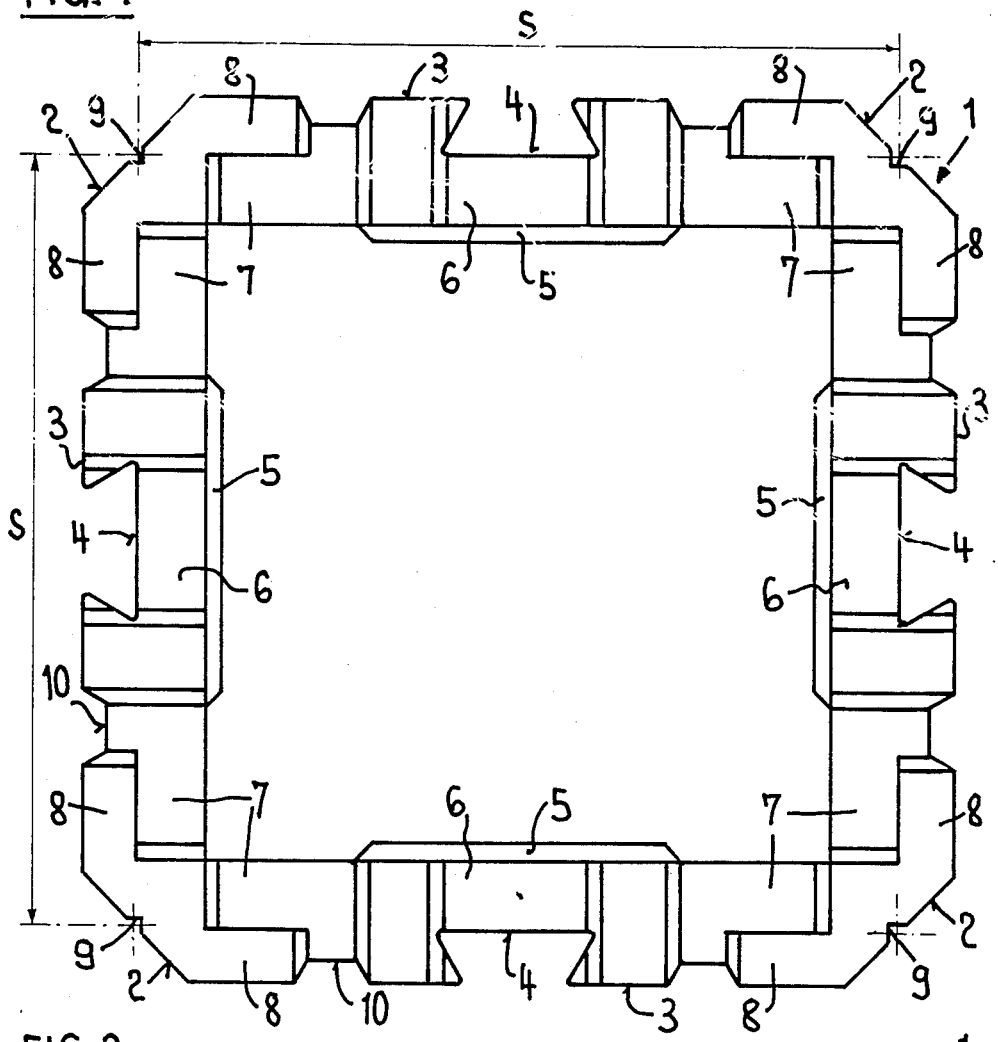
FIG. 1 is a plan view of a first embodiment of a trough-shaped stone forming part of the structural assembly of the present invention.

In FIG. 1, there is shown a substantially square trough-shaped stone member 1 provided with corner regions 2, the external surfaces of which are mitred at an angle of 45°. The stone 1 includes four side wall portions 3, each of which is provided in its central region with a dovetail groove 4. A shoulder portion 5 is attached to the inner surface of each groove, in its central region, to serve as a means for supporting a base portion 14 of the type shown in FIG. 8. The shoulder portion 5 does not extend over the entire width, so that a connecting plate 12 can protrude into the trough-shaped stone as can also be seen in FIG. 8.

The underside of the trough-shaped stone 1 is flat but the upper surface thereof is structured. Thus, the upper surface includes a continuous groove 6 which extends over the width of the dovetailed grooves 4. A recess 7 is provided on each side thereof, which only extends partially therethrough and is defined by a stop member 8 in the edge direction.

Figure 2:
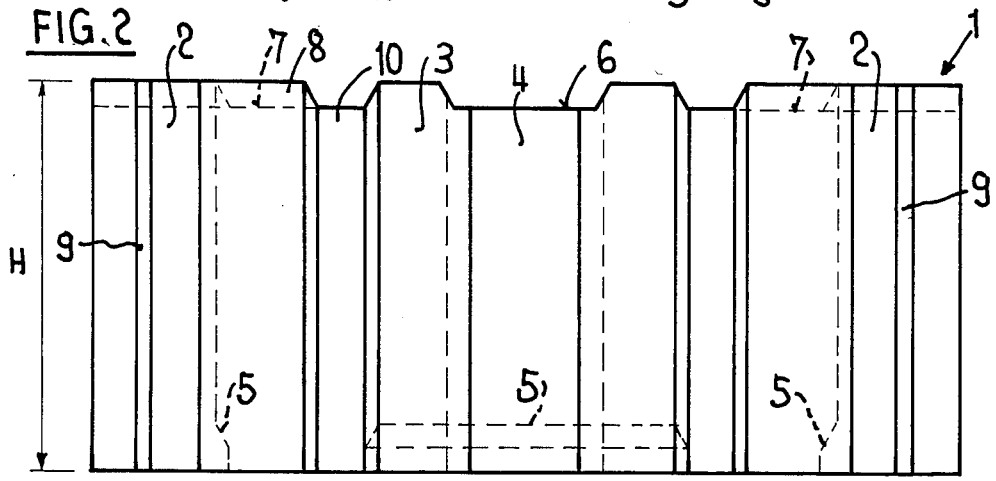
FIG. 2 is a side elevational view of the trough-shaped stone shown in FIG. 1.

In FIGS. 1 and 2, additional structural features are shown which are predominantly provided for aesthetic reasons. However, this does not apply to a small, V-shaped groove 9 provided in the mitred corner regions 2, because these grooves have a multiple function. On the one hand, the trough-shaped stone 1 may be split along this groove to produce an end element 11 of the type shown in FIG. 5 or, on the other hand, the groove serves to align a plurality of trough-shaped stones, as is shown by the groove 9a in FIG. 5 which is formed from a plurality of the V-shaped grooves 9. However, the longitudinally extending recesses 10 provided on each side of the dovetailed groove 4 do serve predominantly aesthetic purposes.

Figure 3:
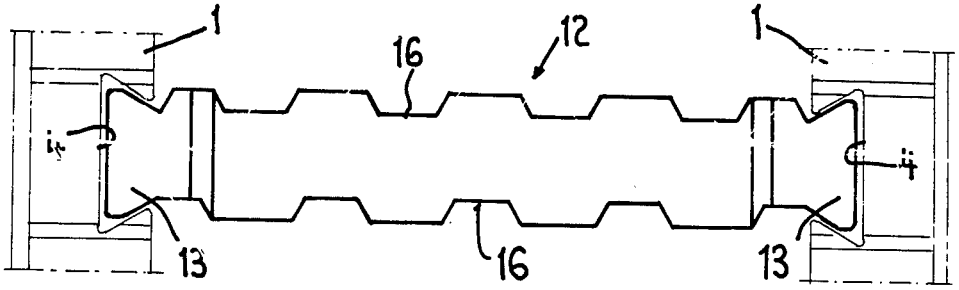
FIG. 3 shows a connecting plate forming a further part of the assembly of the present invention and used to connect two trough-shaped stones.

FIGS. 3 and and 4 illustrate an additional element of the structural assembly, that is to say, the connecting plate 12. At each of its ends, this plate has a dovetail tongue 13 which fits into a dovetailed groove 4 in a trough-shaped stone. As shown particularly in FIG. 4, the overall height of the connecting plate 12 is greater than the overall height of the trough-shaped stone. In this case, the heights are selected so that the connecting plate 12 extends, at most, to the base insert layer 14 seen in FIG. 4. The connecting plate 12 overlaps the trough-shaped stone by an amount equivalent to twice the depth of the groove 6, or the recess 7. The plate 12 is so aligned that a protruding portion 15 thereof is always disposed uppermost. The portion 15 is stepped in order to provide room for the sides of the trough-shaped stone which have the stepped portions 5, as is shown in FIG. 4.

Figure 4:
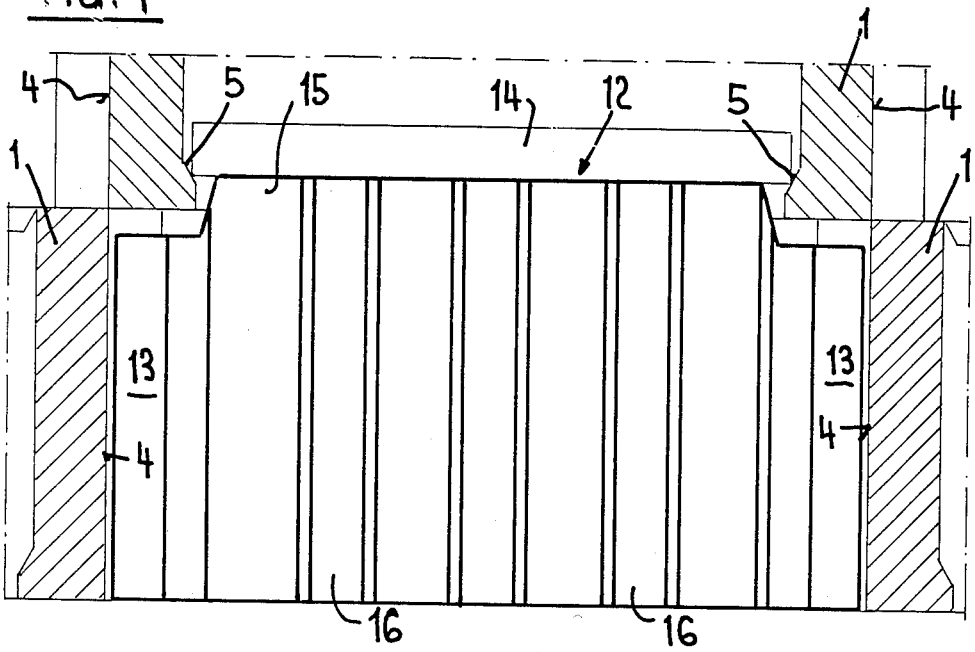
FIG. 4 is a side elevational view of the connecting plate shown in FIG. 3.

Since the connecting plate overlaps the trough-shaped stone by an amount equivalent to twice the depth of the groove or the recess, there can be produced not only an assembly of trough-shaped stones which lie horizontally adjacent one another, but also a combination of trough-shaped stones which lie one above the other, both downwardly and upwardly, with the exception of the lowermost layer which is shown in FIG. 4. The connecting plate 12 is also provided with longitudinal recesses 16.

The base insert layer 14 rests on and is supported by the stepped portions 5 and has a length equal to that of the inner surface of the trough-shaped stone and a width which corresponds to half the length of the trough-shaped stone, so that two base elements can always be fitted into one trough-shaped stone. If the above-mentioned ratios are used for the trough-shaped stone, a side length S (see FIG. 1) of 50 cm can be used. This length S is not the maximum dimension of a side of the stone but the spacing between two ajdacent V-shaped grooves 9, since this is the actual dimension when stacking the trough-shaped stones one above the other. By using such a size, the measurements of the base portion are values which are commercially desirable and which can be produced in very large quantities.

Figure 5:
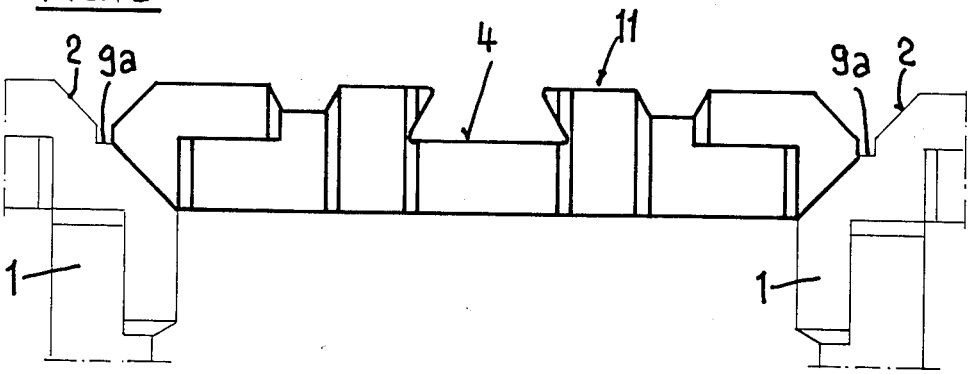
FIG. 5 is a plan view of a portion of a trough-shaped stone serving as an end element.

FIG. 5 illustrates the end plate 11 mentioned hereinbefore and which is produced by dividing the trough-shaped stone 1 into quarters. FIG. 5 thus clearly shows the significance of the mitred corner regions 2 which permits the end plate 11 to be attached and thereby permits an assembly of trough-shaped stones to have a straight edge. It is also clearly apparent from FIG. 5 that it would be possible to reverse the end plate 11 so that its smooth inner surface becomes the external surface.

If the stones are to be erected into a vertical wall, such as a sound-proofing wall which is capable of accommodating plants, it is easy to calculate the number of elements required, as can be seen from FIG. 6. If a length S of 50 cm and a height H of 25 cm are selected for the elements, i.e. for the trough-shaped stone 1 and for the connecting plate 12, it is readily apparent that four trough-shaped stones 1 and four connecting plates 12 are required per square metre of wall. If required or desired, end elements 11 may also be used to provide a continuous surface at the upper and lower ends.

FIG. 7 illustrates a further possible wall assembly and shows that the stones and connecting plates can be interconnected at right angles and can incorporate support elements. It is especially clear from FIG. 7 that it is also possible to divide individual trough-shaped stones 1 into four elements in such a manner that four corner elements 17 are always produced, that is to say, each trough-shaped stone is split down the centre of the dovetailed grooves 4. These corner elements predominantly serve as support means so that a second layer can be mounted thereon. This can also be particularly clearly seen in FIG. 10. It is also apparent from FIG. 7 that the end elements 11 can also be connected to the connecting plates 12 because, of course, each of the end elements also has a respective dovetailed groove 4. The mitred corners 2 also permit the trough-shaped stones to be disposed diagonally with respect to one another, as is shown in FIG. 7. Since the trough-shaped stones are sealingly edged by the base elements 14 at their lower ends, they can easily accommodate plants. It is particularly clear from FIG. 7 that the lowermost layer, in particular, and the crown or top of the wall can be edged by the end elements, such end elements 11 being used with their dovetailed grooves 4 extending inwardly, and being held together by the connecting plates 12.

FIG. 8 shows the trough-shaped stones in a fully inter-connected, offset arrangement as used, for example, for a sloping wall. In this example, and utilising the above-specified measurements, the slope angle is 60°. FIG. 8 shows that each connecting plate 12 engages in the trough-shaped stone disposed thereabove and in the trough-shaped stone disposed therebeneath. In order to achieve the offset arrangement, that is to say, to provide a slope angle of 60°, each connecting plate 12 engages in the recesses 7 of the trough-shaped stone situated therebeneath. FIG. 8 also shows that, in the case of the upper trough-shaped stones, only one base element is required to produce a continuous connection with the soil or ground or for roots to be formed in the slope or embankment.

Figure 9:
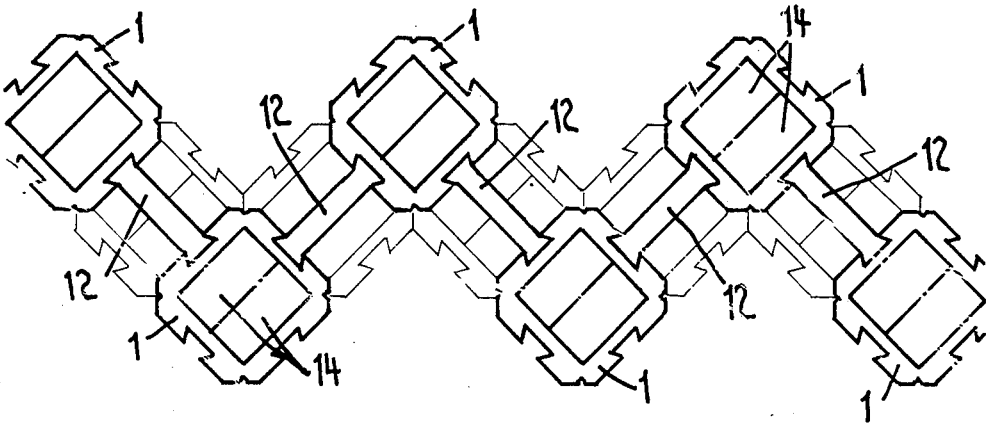
FIG. 9 is a plan view of a still further wall formed from the structural elements shown in FIGS. 1 to 5.

FIG. 9 illustrates an additional wall which may also serve, for example, as a sound-proofing wall which is capable of accommodating plants on both sides thereof, the zig-zag arrangement being particularly sound-damping. Here also, both entire trough-shaped stones and corner elements are used, the individual trough-shaped stones being interconnected by means of the connecting plates 12. It is also possible to edge the outer walls by means of the end elements. In particular, this Figure clearly shows that this construction method utilising connections at 90° is made possible only because of the mitred corners 2.

Figure 10:
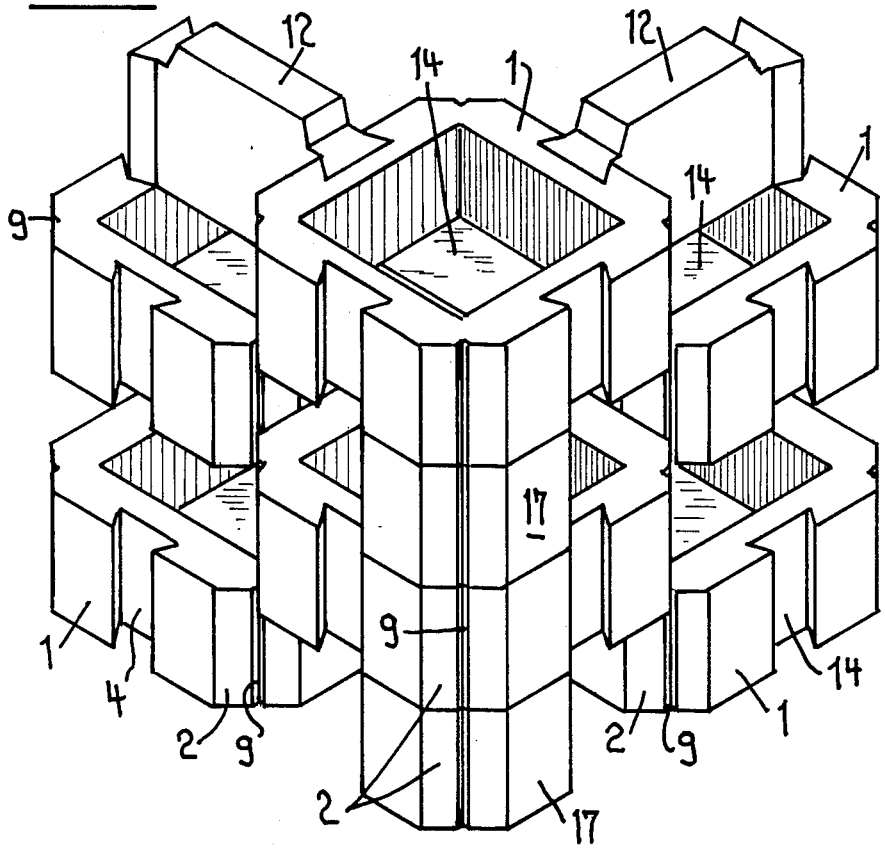
FIG. 10 is a side elevational view of a portion of the wall shown in FIG. 9 but on an enlarged scale relative thereto.

FIG. 10 is a detailed, perspective view of a corner of the wall of FIG. 9 and clearly shows the arrangement. At the bottom of the drawing, at the front, there is shown a corner element 17 and on each side thereof is a trough-shaped stone 1, whereupon one layer can be seen as having one trough-shaped stone 1 disposed above the corner element and, subsequently, additional trough-shaped stones are provided which are held together by connecting plates 12. Here also, the V-shaped groove 9 in the inclined corner 2 may serve to align the elements. In particular, this FIG. 10 clearly shows that this arrangement provides a large area which can accommodate plants. Walls may be secured very easily through the intermediary of a connecting plate to which a trough-shaped stone or an end element is attached, the connecting plate being connected to a trough-shaped stone through the intermediary of the dovetail joint.

What I claim:

1. A structural assembly comprising:

a first member including a first and second pair of substantially parallel and opposed vertical side walls, a lateral external surface of each side wall of said first pair having an external vertical groove, and an upper surface of each side wall of said first pair having a horizontal continuous groove adjacent said vertical groove, and a pair of recesses disposed one to either side of said continuous groove, each of said recesses sharing a common border with said continuous groove on a first side and being at least partially obstructed by a stop member on a second side opposite said first side; and a second member including at least one vertical tongue member dimensioned to fit into one of said vertical grooves.

2. A structural assembly as recited in claim 1, wherein adjacent side walls jointly define corner regions having an external surface, and wherein said external surface of said corner regions is inclined at an angle of 45° and each said corner region defines a central V-shaped groove.

3. A structural assembly as recited in claim 2, wheein said first member is cleavable along each said V-shaped groove to produce four end elements.

4. A structural assembly as recited in claim 1, wherein said first member is cleavable along the centre of each said dovetail groove to produce four corner elements.

5. A structural assembly as recited in claim 2, wherein the lateral length of each said first members, measured between said V-shaped grooves, is 50 cm and the height of said first member is 25 cm.

6. A structural assembly as recited in claim 1, wherein said side walls all have substantially the same length measured between pairs of side walls, and wherein said second member has substantially the same length as said side walls.

7. A structural assembly as recited in claim 1, wherein said dovetailed grooves all have substantially the same vertical length, and wherein said second member has a vertical dimension greater than said same vertical length.

8. A structural assembly comprising:

a plurality of contiguous vertical facets arranged to form a closed perimeter having a vertical recess therethrough, each facet having an inner vertical wall facing said recess, and an outer vertical wall opposite said inner wall;

interlocking means disposed on each outer wall, said interlocking means being substantially parallel to said recess; and shoulder means on each inner vertical wall for supporting a shelf member horizontally.

9. A structural assembly as recited in claim 8, further comprising:

an interconnecting means having first and second end means for engaging with said interlocking means.

10. A structural assembly as recited in claim 9, wherein the height of said interconnecting means is greater than the height of said facets.

11. A structural assembly as recited in claim 10, wherein said interconnecting means has first and second regions of a first height, and a third region of a second height; and wherein said first height is less than the height of said facets; and wherein said second height is greater than the height of said facets.

12. A structural assembly as recited in claim 8, wherein said interlocking means is a dovetail shaped groove.

13. A structural assembly as recited in claim 8, wherein an upper surface of said perimeter has a plurality of grooves and raised surfaces.

14. A structural assembly as recited in claim 13, wherein said raised surfaces are positioned on said upper surface, adjacent each side of said interlocking means and at contiguous points of said facets.

15. A structural assembly as recited in claim 8, wherein a groove means is positioned along contiguous edges of said facets.

16. A structural assembly according to claim 8, further comprising:

a shelf member supported by at least three of said shoulder means.

17. A structural assembly according to claim 16, wherein said shelf member is comprised of discrete halves.

18. A structural assembly as recited in claim 8, wherein said perimeter comprises four facets.

19. A method of erecting a sloping wall of a plurality of first members, each comprising two pairs of substantially parallel and opposed side walls, each side wall of at least one pair defining an external dovetailed groove, and a top edge of said at least one pair of side walls defining a recess, and a plurality of second members, each including at least one dovetailed tongue dimensioned to fit into said dovetailed groove, comprising the steps of:

forming a first row by horizontally interconnecting a predetermined number of said first members by connecting a second member between adjacent pairs of said first members, said connecting being accomplished by fitting said tongue into one of said grooves; and forming a second row by horizontally interconnecting a second predetermined number of said first members between adjacent pairs of said predetermined number of first members, said second row being horizontally offset from said first row by a distance equal to a distance between said recess and one of said walls of said second pair of opposed walls.

20. A structural assembly comprising:

a first member including a first and second pair of vertical side walls arranged substantially parallel and opposed to define an internal cavity, a lateral external surface of each side wall of said first pair having an external vertical groove, and a lateral internal surface of each of said side walls having a shoulder portion protruding into said cavity;

a second member including at least one vertical tongue member dimensioned to fit into one of said vertical grooves; and a base element dimensioned to be supportable horizontally in said cavity by at least three of said shoulder portions.

21. A structural assembly as recited in claim 20, wherein said base element is dimensioned to span said cavity horizontally, and so to rest on four shoulder portions.

22. A structural assembly as claimed in claim 20, wherein said base element is dimensioned to span one half of said cavity horizontally, and to rest on substantially all of one shoulder portion of one side wall of said first pair and on about one-half of each of the shoulder portions of said second pair of said walls, so that said cavity can accommodate, and said shoulder portions can support, two such base elements.

23. A method of erecting a wall from (1) a plurality of block members, said block members each comprising first and second pairs of substantially parallel and opposed vertical side walls, each side wall of said first pair having an external vertical groove, and (2) a plurality of connecting members, said connecting members each comprising a pair of vertical tongues dimensioned to be received in said vertical grooves and separated by a distance substantially equal to a distance between said first pair of vertical side walls of said block members, said method comprising the steps of:

(a) laying down one course of said wall by connecting block members together using connection members having each of their tongues fitted into grooves of horizontally adjacent block members, respectively; and (b) laying down a vertically adjacent and lengthwise offset course of said wall by connecting block members together using connecting members having each of their tongues fitting into grooves of horizontally adjacent block members, respectively, and positioning block members of said vertically adjacent course over connecting members of said one course.

24. A structural assembly comprising:

a first member including a first and second pair of substantially parallel and opposed vertical side walls, a lateral external surface of each side wall of said first pair having an external vertical groove, and an upper surface of each side wall of said first pair having a horizontal continuous groove adjacent said vertical groove, and a pair of recesses disposed one to either side of said continuous groove, each of said recesses being at least partially obstructed by a stop member; and a second member including at least one vertical tongue member dimensioned to fit into one of said vertical grooves; and wherein the height of said second member exceeds the height of said first member by twice the depth of said continuous groove or of said recess, said second member further including an upper, longitudinally extending side; and wherein said side walls of said first member each have internal and external surfaces and upper and lower edges connecting said internal and external surfaces, each of said side walls including a shoulder portion disposed in the region of said lower edge on said internal surface for receiving base elements, said side of said second member including a stepped end region, said stepped end region having a height corresponding to the thickness of said shoulder portion in said first member.

* * * * *

UNITED STATES PATENT AND TRADEMARK OFFICE

CERTIFICATE OF CORRECTION

PATENT NO. : 4,782,640

DATED : November 8, 1988

INVENTOR(S) : Rolf Scheiwiller

It is certified that error appears in the above—identified patent and that said Letters Patent is hereby corrected as shown below:

Column 6, line 6, "said walls" should be -- side walls --.

Signed and Sealed this

Twenty-third Day of May, 1989

*Attest:*

DONALD J. QUIGG

*Attesting Officer*

*Commissioner of Patents and Trademarks*